US006971407B2

(12) United States Patent
Christensen et al.

(10) Patent No.: US 6,971,407 B2
(45) Date of Patent: Dec. 6, 2005

(54) HYDRAULIC VALVE ARRANGEMENT

(75) Inventors: Thorkild Christensen, Sønderborg (DK); Carsten Christensen, Broager (DK); Siegfried Zenker, Kirchseeon (DE)

(73) Assignee: Sauer-Danfoss APS, Nordborg (DK)

( * ) Notice: Subject to any disclaimer, the term of this patent is extended or adjusted under 35 U.S.C. 154(b) by 28 days.

(21) Appl. No.: 10/734,838

(22) Filed: Dec. 12, 2003

(65) Prior Publication Data

US 2004/0163719 A1 Aug. 26, 2004

(30) Foreign Application Priority Data

Dec. 14, 2002 (DE) ..... 102 58 517

(51) Int. Cl.[7] ..... F15B 13/04
(52) U.S. Cl. ..... 137/596.13; 91/446
(58) Field of Search ..... 91/446; 137/596.13

(56) References Cited

U.S. PATENT DOCUMENTS 4,180,098 A 12/1979 Budzich ..... 137/596.13
4,343,152 A 8/1982 Habiger
5,829,481 A * 11/1998 Tajima et al. ..... 137/116.5
6,220,289 B1 4/2001 Zenker et al.

FOREIGN PATENT DOCUMENTS

| | | |
|---|---|---|
| DE | 41 19 297 A1 | 12/1992 |
| DE | 4405143 | 8/1995 |
| EP | 0170815 | 2/1986 |
| FR | 2 745 337 | 8/1997 |
| JP | 56-20807 | 2/1981 |

* cited by examiner

*Primary Examiner*—Gerald A. Michalsky
(74) *Attorney, Agent, or Firm*—McCormick, Paulding & Huber LLP

(57) ABSTRACT

The invention concerns a hydraulic valve arrangement with a supply connection arrangement, which has a high-pressure connection (P) and a low-pressure connection (T), a working connection arrangement, which has two working connections (A, B), which can be connected with a consumer, a directional valve and a compensation valve arranged between the directional valve and the supply connection arrangement, the pressure outlet of the compensation valve being connected with a pressure inlet of the directional valve. It is endeavoured to avoid dangerous situations, which occur because of uncontrolled pressures. For this purpose, it is ensured that the compensation valve has a relief outlet, which can be connected with the pressure outlet.

16 Claims, 3 Drawing Sheets

HYDRAULIC VALVE ARRANGEMENT

CROSS-REFERENCE TO RELATED APPLICATIONS

This application is entitled to the benefit of and incorporates by reference essential subject matter disclosed in German Patent Application No. 102 58 517.2 filed on Dec. 14, 2002.

FIELD OF THE INVENTION

The invention concerns a hydraulic valve arrangement with a supply connection arrangement, which has a high-pressure connection and a low-pressure connection, a working connection arrangement, which has two working connections, which can be connected with a consumer, a directional valve and a compensation valve arranged between the directional valve and the supply connection arrangement, the pressure outlet of the compensation valve being connected with a pressure inlet of the directional valve.

BACKGROUND OF THE INVENTION

Such a hydraulic valve arrangement is known from DE 199 19 015 A1. The compensation valve, which can also be called pressure balance valve or pressure control valve for the directional valve, is arranged in front of the inlet of the directional valve. It ensures that a constant pressure difference always exists over the directional valve, that is, the compensation valve controls the supply of hydraulic fluid to the directional valve in dependence of the degree of opening of the directional valve.

Such a valve arrangement is often used in a hydraulic system, in which several such valve arrangements are provided next to each other. Each of these valve arrangements controls its own consumer, for example a motor. An example of this is a hydraulically driven excavator, which has various motors for the control of various elements when moving the excavator bucket. A first motor is provided to control the inclination of a beam. A second motor controls the movement of an arm in relation to the beam, and a third motor controls the movement of the bucket in relation to the arm.

When, for example, a motor is activated and has a corresponding pressure requirement, this pressure must be available at the high-pressure connection. However, this high pressure then also rules at the high-pressure connections of the other valve arrangements. In connection with higher pressures, the practically unavoidable leakages may cause the pressure to propagate to a motor, which should not be activated, causing this motor to move, even though this is not desired. This is particularly dangerous, when, for example, such parasitic pressure propagations cause the lifting of a load.

It is possible to provide safety valves between the directional valve and the motor. However, under certain circumstances, such safety valves can be opened by the parasitic pressure propagations. Valves cannot with reasonable efforts, prevent leakages.

SUMMARY OF THE INVENTION

The invention is based on the task of preventing dangerous situations, which occur because of uncontrolled pressures.

With a hydraulic valve arrangement, this task is solved in that the compensation valve has a relief outlet, which can be connected with the pressure outlet.

With this embodiment, the compensation valve gets a second function. Now, it does not only have to ensure that the pressure over the directional valve is kept constant. It also ensures that from a certain level, a relief occurs at a pressure increase at the pressure outlet of the compensation valve, in that the pressure outlet of the compensation valve is connected with the relief outlet. Via the relief outlet, the pressure at the pressure outlet can be reduced. Thus, it is prevented at an early stage that pressures can be built up, which can propagate via leakages into areas of the valve arrangement, where they can do harm, for example in activating a motor. The required modification of the compensation valve is relatively small. A relief outlet can be provided at low cost.

Preferably, the relief outlet is connected with the low-pressure connection. Thus, the pressure at the pressure outlet can be reduced to the pressure in the low-pressure line. In most cases, this is the pressure ruling in the tank for the hydraulic fluid, in other words, tank pressure. When the pressure at the pressure outlet has been reduced to the tank pressure, it usually takes a certain time, in spite of possibly existing leakages, until, with closed compensation valve, the pressure has again built up to a level, which can, under certain circumstances, be dangerous. Before this happens, however, the pressure outlet can be connected with the relief outlet again, so that dangerous situations can be avoided in a relatively reliable manner.

In an alternative embodiment it may be ensured that the relief outlet is connected with a load sensing line, which is connected with the directional valve. Also in this way, the pressure outlet is practically relieved to tank pressure. In the neutral position of the directional valve, the load sensing line is namely connected with the low-pressure connection, so that the pressure can then be relieved to the tank via the load-sensing line and the directional valve.

Preferably, the compensation valve has a valve element, movable in opposite directions from a normal position, which performs a pressure control function when moved in one direction and a pressure relief function when moved in the opposite direction. Thus, the design of the compensation valve can be as usual. It merely has to be ensured that from the normal position, in which the compensation valve is normally closed, the valve element of the compensation valve can be moved in another direction. After the movement in the other direction, the valve element can then release a path between the pressure outlet and the relief outlet.

It is advantageous that the valve element is in the form of a slide, which is acted upon on one side by the pressure in the load-sensing line and the force of a spring and on the other side by the pressure at the pressure outlet. This is the usual design of a compensation valve. Because of the fact that the valve element, namely the slide, can be displaced from its normal position, this ensures, however, that the slide can create the desired connection between the pressure outlet and the relief outlet, when the pressure at the pressure outlet exceeds the force of the spring. When the motor is not supposed to be activated via the working connection arrangement, a lower pressure, for example tank pressure, usually rules in the load-sensing line. Thus, it is ensured that the pressure at the pressure outlet of the compensation valve cannot exceed the tank pressure substantially, when the directional valve is dosed. The pressure difference, which is required to open the relief outlet, depends on the force of the spring.

Preferably, the slide has a longitudinal channel, which is connected with the pressure outlet via a diagonal bore and ends in a first pressure chamber, the longitudinal channel extending over the diagonal bore and being connectable with a second pressure chamber via a lockable connection, in which a relief pressure rules. The longitudinal channel, which is connected with the first pressure chamber, is known from traditional compensation valves. Via the diagonal bore, the pressure at the pressure outlet is led on to the first pressure chamber, so that the slide can adjust to keep the pressure over the connected directional valve constant. With a relatively small modification, the slide of the compensation valve can now be changed in such a way that it can perform the additional function, namely the pressure relief. For this purpose, it is merely required to extend the longitudinal channel over the diagonal bore and let it end in the second pressure chamber via a bore. Of course, the bore has to be lockable, so that the pressure at the pressure outlet is not short-circuited, when a pressure shall be passed on to the directional valve.

Preferably, the second pressure chamber is connected with the load-sensing line. This embodiment has the advantage that the second pressure chamber can be used for two purposes. Firstly, it serves the purpose of relieving the pressure of the pressure outlet so that no dangerous situations can occur. Secondly, it serves the purpose of acting upon the slide with pressure in such a way that during the pressure compensation operation, that is, on a demand for fluid, it is displaced in the right direction to keep the pressure drop over the directional valve constant.

Preferably, the lockable opening is formed on the circumference of the slide and covered over a certain movement path by the wall of a housing bore, in which the slide is arranged. With regard to design, this is a relatively simple embodiment with a view to making the release of a connection between the longitudinal bore and the second pressure chamber depend on the position of the slide. When the slide has been displaced in the direction of the second pressure chamber over a predetermined path, in which it compresses the spring, the wall of the bore releases the opening and the pressure can be relieved from the pressure outlet to the second pressure chamber.

Preferably, the predetermined movement path is shorter than a path, after which the slide releases a connection between the pressure outlet and the high-pressure connection. The slide has a circumferential projection, which forms a sealing zone together with a part of the wall of the housing bore. When the slide is displaced to the pressure control position, throttling grooves on the circumferential projection release a flow path between the high-pressure connection and the pressure outlet. Now, it is ensured that this sealing zone is long enough, so that the wall of the housing bore releases the opening, before the sealing in this sealing zone is abandoned. When the slide is displaced to the "relief position", a direct pressure passage can never be established between the high-pressure connection and the pressure outlet.

It is also advantageous that a non-return valve is arranged in the longitudinal channel between the opening and the diagonal bore. With this non-return valve, it is avoided that in extreme cases, when displacing the slide in the compensation direction, a short-circuit exists between the pressure outlet and the high-pressure connection and, for example, a load is lowered involuntarily, when the pressure at the pressure outlet is larger than the pressure at the high-pressure connection and stop valves are not provided between the motor and the directional valve.

BRIEF DESCRIPTION OF THE DRAWINGS

In the following, the invention is explained in detail on the basis of preferred embodiments in connection with the drawings, showing.

DETAILED DESCRIPTION OF THE PREFERRED EMBODIMENTS

Figure 1:
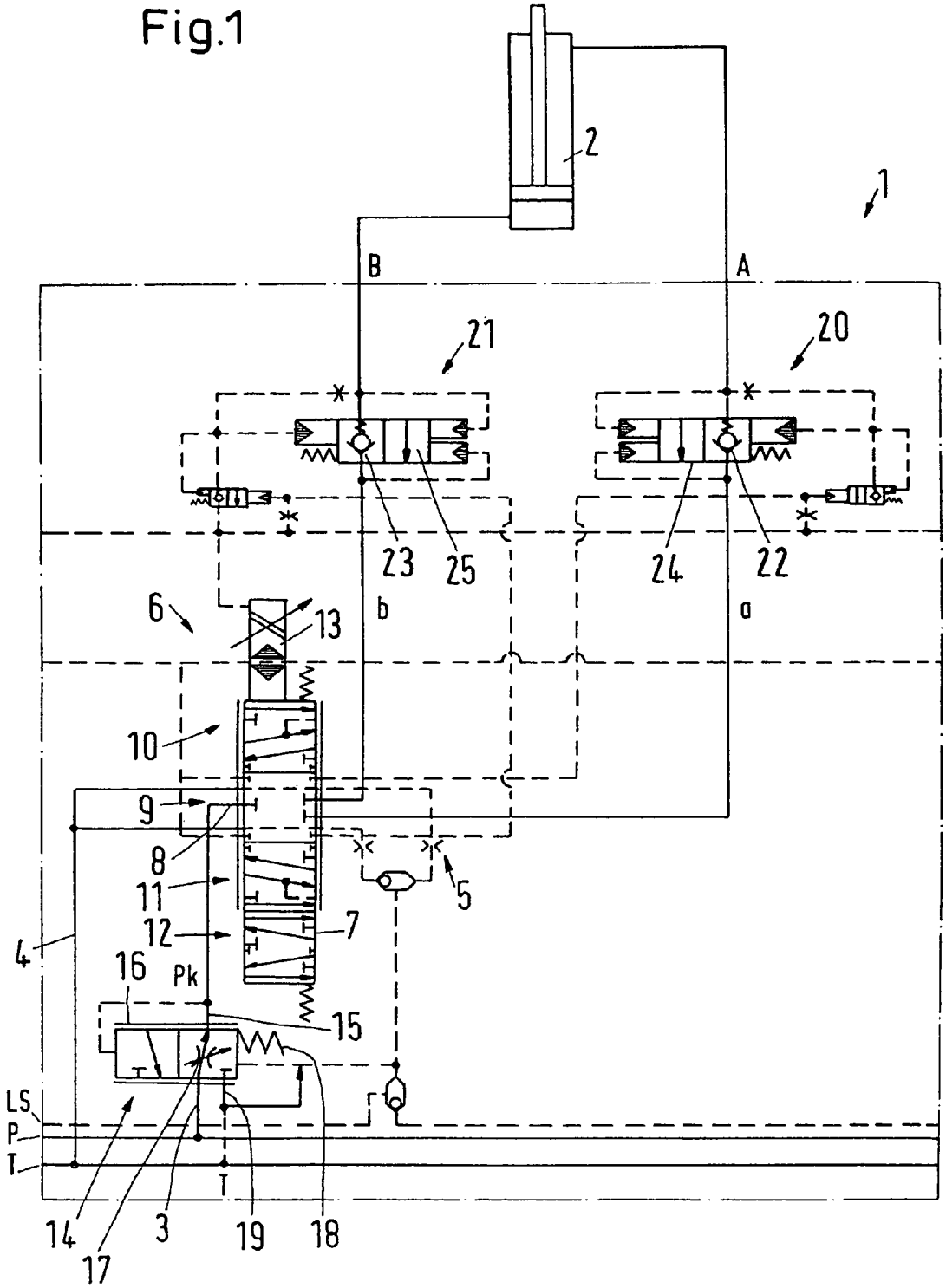
FIG. 1 is a schematic connection diagram of a valve arrangement

FIG. 1 shows a valve arrangement 1, which is preferably built up by modules and serves the purpose of activating a motor 2. The motor is connected to a working connection arrangement with two working connections A, B, working lines a, b leading to said connections A, B.

Further, the valve arrangement 1 has a supply connection arrangement with a high-pressure connection P, which is connected with a pump line 3, and a low-pressure connection T, which is connected with a tank line 4. Further, a load-sensing line LS is provided, which is connected with a load-sensing system 5.

A directional valve 6 controls the activation of the motor 2 with regard to direction and deflection. The directional valve 6 has a slide 7, which can be displaced between a total of four positions. In the shown neutral position 9, a pressure inlet 8 of the directional valve 6 is separated from the working lines a, b, which lead to the working connections A, B. The load-sensing system 5 is connected with the tank line 4. Further, two activation positions 10, 11 are provided, in which the pressure inlet 8 is connected with one of the working lines a, b, respectively, while the other working line b, a, is connected with the tank line 4. In a float position 12 both working connections a, b are connected with the tank line 4. A magnetic drive 13, only shown schematically, or a hand gear, not shown in detail, activates the slide 7.

Between the pump line 3 and the pressure inlet 8 of the directional valve 6 is arranged a load-sensing controlled compensation valve 14, whose pressure outlet 15 is connected with the pressure inlet 8 of the directional valve. The compensation valve 14 has a slide 16, for which two positions are symbolised.

In the position shown in FIG. 1, the slide 16 connects the pump line 3 with the pressure outlet 15 via an adjustable throttle 17. In this connection, the slide 16 is acted upon on the one side by a pressure Pk at the pressure outlet and on the other side by the pressure in the LS-system 5 as well as the force of a spring 18. In this control position, the slide 16 is set so that the pressure over the directional valve 6 can be kept constant.

In its other position, the slide 16 connects the pressure outlet 15 of the compensation valve 14 with a relief outlet 19.

The relief outlet 19 is, as shown with a full line, connected with the load-sensing system 5. In an alternative, shown with dotted lines, the load outlet 19 can also be connected with the low-pressure line T. The effect is the same in both cases, as will be explained later.

In the two working lines a, b are arranged stop valves 20, 21, each having a non-return valve 22, 23 and a through-path 24, 25. Depending on the direction, in which the motor must be activated, one of the stop valves is activated. The drives required for this purpose are only shown schematically. For further details, please see the description in DE 199 19 015 A1.

The valve arrangement 1 now works as follows: When the directional valve 6 is activated, a pressure occurs in the load-sensing system 5, which pressure acts upon the slide 16 of the compensation valve 14 and displaces the slide 16 so that hydraulic fluid under a predetermined pressure can be supplied to the pressure inlet 8 of the directional valve 6. The pressure is kept constant, independently of the size of the "consumption" by the motor 2. The directional valve 6 thus determines the deflection of the motor 2 with regard to amount and direction.

When a motor 2 is activated, the corresponding pressure must be available at the high-pressure line P. This pressure then exists at all modules or valve arrangements 1, which are connected with the same high-pressure line P.

When now the directional valve 6 of one of the connected valve arrangements 1 is closed, it is possible, due to unavoidable leakages, that the hydraulic fluid under high pressure available in the high-pressure line P can reach the pressure outlet 15 through the compensation valve 14. With an accordingly increasing pressure it is also possible that the fluid under pressure reaches the working lines a, b and then activates the motor 2.

In order to avoid this, the relief outlet 19 is provided, to which the pressure Pk can be relieved, when this pressure Pk exceeds the force of the spring 18.

When the slide 7 of the directional valve 6 is in the shown neutral position 9, the load-sensing system 5 is connected with the tank line 4. Thus, the pressure in the load-sensing system 5 acts practically without force upon the slide 16, so that merely the force of the spring 18 acts in one direction. In the opposite direction the pressure Pk acts, which then displaces the slide 16 so that a connection between the pressure outlet 15 and the relief outlet 19 is established. The pressure Pk can then flow off to the low-pressure connection T either via the load-sensing system 5 or directly. As soon as the pressure at the pressure outlet 15 of the compensation valve 14 has been sufficiently reduced, the slide 16 moves back to its normal position.

Thus, it is avoided that at the pressure outlet 15 of the compensation valve a pressure Pk is built up, which substantially exceeds the pressure in the load-sensing system 5.

Figure 2:
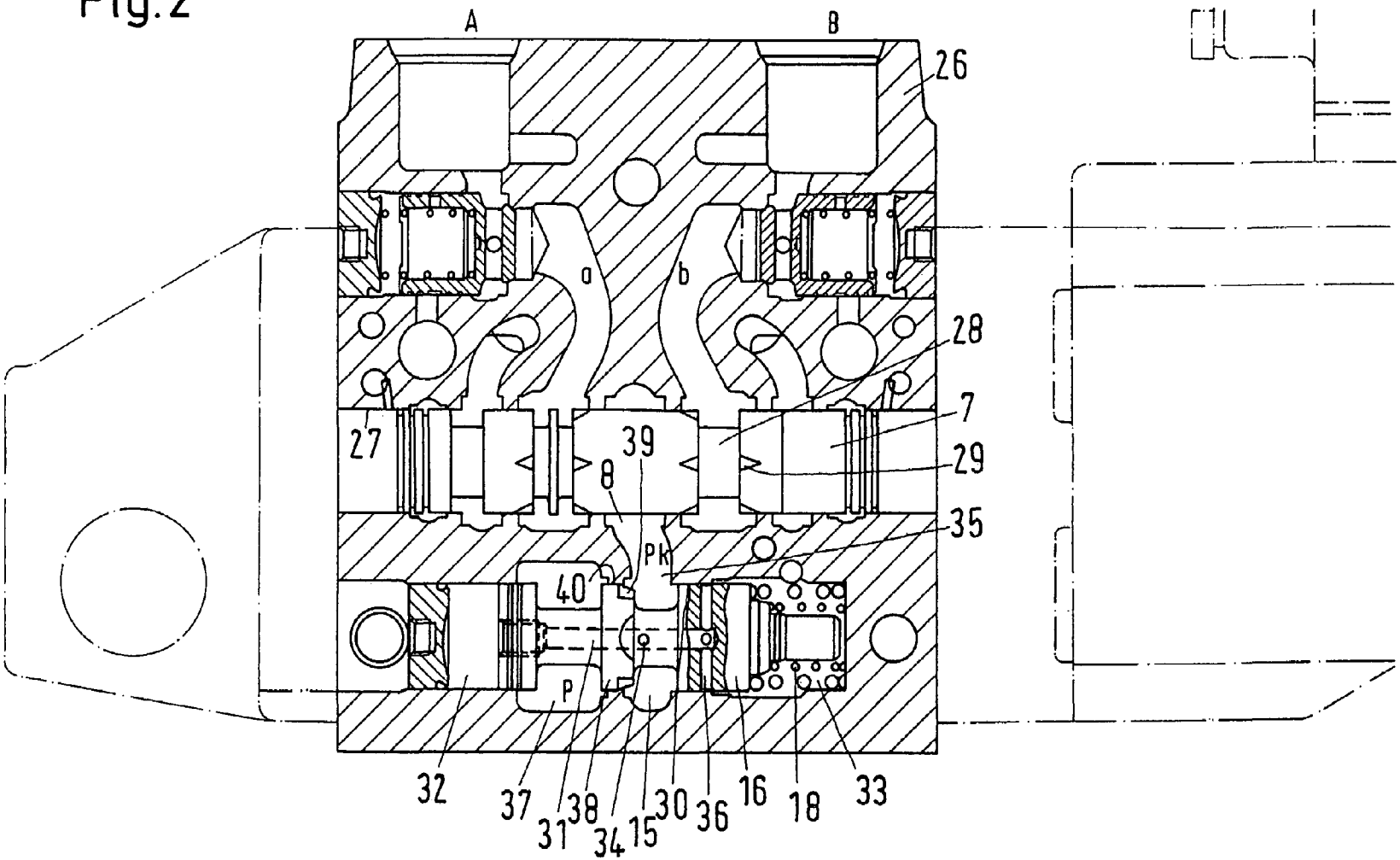
FIG. 2 is a schematic cross-section of a valve arrangement

One possibility of realising such system in a valve arrangement is shown in FIG. 2. In FIG. 2, parts corresponding to those in FIG. 1 have the same reference numbers.

In a housing 26, the slide 7 of the directional valve is arranged to be axially displaceable. The slide 7 is arranged in a bore 27 in the housing 26. As known per se and therefore not explained in detail, it has several recesses 28 and throttling grooves 29, so that a fluid flow from the pressure inlet 8 to the working connections A, B is possible in dependence of the position of the slide 7.

The slide 16 of the compensation valve, which is arranged in a housing bore 30, can be seen. The slide 16 has a longitudinal channel 31, which penetrates the slide over a certain part of its length and opens at one end (in FIG. 2 left) into a first pressure chamber 32. At the opposite end of the slide 16 a second pressure chamber 33 is provided, in which the spring 18 is arranged and which is connected with the LS-system 5. Via a diagonal bore 34, the longitudinal channel 31 is connected with the pressure outlet 15. The pressure outlet 15 is formed by a circumferential groove in the housing bore 30, which is connected with the pressure inlet 8 of the directional valve 6 via a channel 35.

The longitudinal channel extends over the diagonal bore 34 into another diagonal bore 36, which ends in the circumference of the slide 16 and is covered by the housing bore 30 in the position of the slide 16 shown in FIG. 2. When, however, the slide is displaced by a small distance to the right against the force of the spring 18, the bore 36 is released by the housing bore 30 and a connection exists between the pressure outlet 15 and the second pressure chamber 33.

The pump line 3 ends in a recess 37 of the housing bore 30. The slide 16 has a circumferential projection 38 with throttling grooves 39, the projection 38 forming, in the position shown in FIG. 2, a sealing zone 40 together with the housing bore 30. The overlapping between the projection 38 and the housing bore 30 still exists, when the end of the bore 36 opens into the second pressure chamber 33.

When the pressure in the second pressure chamber 33 increases, because of a pressure increase in the load-sensing system 5, the slide 16 is displaced to the left, because the force, with which the pressure in the load-sensing system 5 acts upon the slide, is larger than the force, with which the pressure Pk acts upon the opposite side of the slide 16. A fluid flow from the high-pressure connection P to the pressure inlet 8 of the directional valve can occur.

When, however, the compensation valve is closed (as shown in FIG. 2), and a pressure caused by leakages occurs at the pressure outlet 15 of the compensation valve, this pressure reaches the first pressure chamber 32 via the longitudinal channel 31 and displaces the slide 16 to the right against the force of the spring 18, so that the bore 36 opens into the second pressure chamber 33, which is at this instant practically pressureless. The fluid from the pressure outlet 15 can then flow into the second pressure chamber 33.

Figure 3:
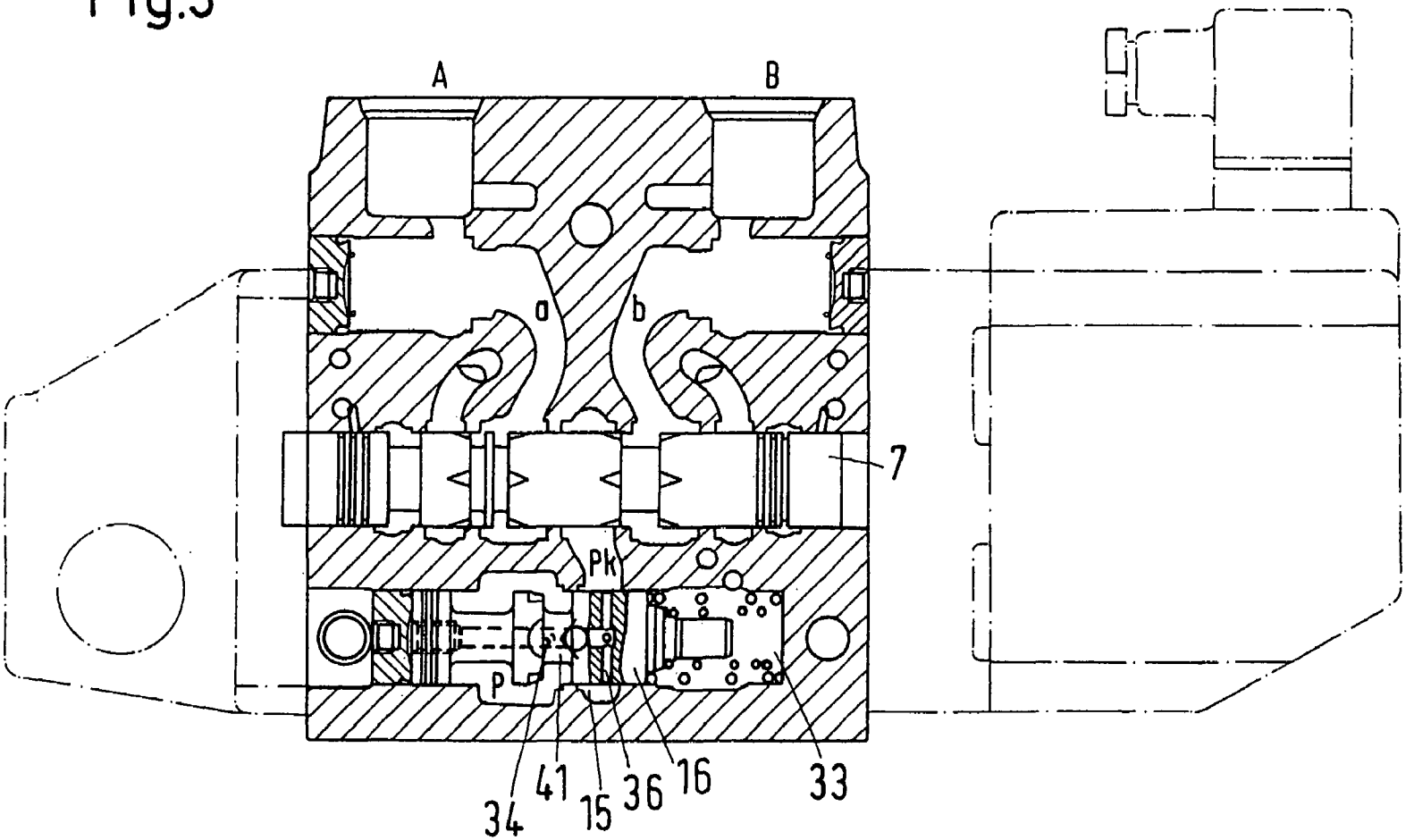
FIG. 3 is a schematic cross-section of a second embodiment of the valve arrangement.

FIG. 3 shows a further embodiment, which substantially corresponds to the one in FIG. 2. The only change is that a non-return valve 41 is arranged in the slide 16 between the bore 36, which opens into the second pressure chamber 33 and the diagonal bore 34, which opens into the pressure outlet 15.

In FIG. 3, the slide 16 is shown in an extreme position, in which the slide 7 of the directional valve has practically completely released a path from the working connection B to the pressure outlet 15 of the compensation valve.

The valve arrangement shown in FIG. 3 can also be used, when the stop valves 20, 21 are not available.

What is claimed is:

1. A hydraulic valve arrangement comprising a supply connection arrangement, having a high-pressure connection and a low-pressure connection, a working connection arrangement, having two working connections, which can be connected with a consumer, a directional valve and a compensation valve arranged between the directional valve and the supply connection arrangement, the pressure outlet of the compensation valve being connected with a pressure inlet of the directional valve, and wherein the compensation valve has a relief outlet, which can be connected with the pressure outlet, wherein the relief outlet is connected with a load-sensing line, which is connected with the directional valve.

2. A valve arrangement according to claim 1, wherein the relief outlet is connected with the low-pressure connection (T).

3. A valve arrangement according to claim 1, wherein the compensation valve has a valve element, movable in opposite directions from a normal position, which performs a pressure control function when moved in one direction and a pressure relief function when moved in the opposite direction.

4. A valve arrangement according to claim 3, wherein the valve element is in the form of a slide, which is acted upon on one side by the pressure in the load-sensing line and the force of a spring and on the other side by the pressure at the pressure outlet.

5. A valve arrangement according to claim 4, wherein the slide has a longitudinal channel, which is connected with the pressure outlet via a diagonal bore and ends in a first pressure chamber, the longitudinal channel extending over the diagonal bore and being connectable with a second pressure chamber via a lockable connection, in which a relief pressure rules.

6. A valve arrangement according to claim 5, wherein the second pressure chamber is connected with the load-sensing line.

7. A valve arrangement according to claim 5, wherein the lockable opening is formed on the circumference of the slide and covered over a certain movement path by the wall of a housing bore, in which the slide is arranged.

8. A valve arrangement according to claim 7, wherein the predetermined movement path is shorter than a path, after which the slide releases a connection between the pressure outlet and the high-pressure connection (P).

9. A valve arrangement according to claim 5, further comprising a non-return valve arranged in the longitudinal channel between the opening and the diagonal bore.

10. A hydraulic valve arrangement comprising a supply connection arrangement, having a high-pressure connection and a low-pressure connection, a working connection arrangement, having two working connections, which can be connected with a consumer, a directional valve and a compensation valve arranged between the directional valve and the supply connection arrangement, the pressure outlet of the compensation valve being connected with a pressure inlet of the directional valve, and wherein the compensation valve has a relief outlet, which can be connected with the pressure outlet, wherein the compensation valve has a valve element, movable in opposite directions from a normal position, which performs a pressure control function when moved in one direction and a pressure relief function when moved in the opposite direction, wherein the valve element is in the form of a slide, which is acted upon on one side by the pressure in a load-sensing line and the force of a spring and on the other side by the pressure at the pressure outlet, and wherein the slide has a longitudinal channel, which is connected with the pressure outlet via a diagonal bore and ends in a first pressure chamber, the longitudinal channel extending over the diagonal bore and being connectable with a second pressure chamber via a lockable connection, in which a relief pressure rules.

11. A valve arrangement according to claim 10, wherein the relief outlet is connected with the low-pressure connection.

12. A valve arrangement according to claim 10, wherein the relief outlet is connected with a load-sensing line, which is connected with the directional valve.

13. A valve arrangement according to claim 10, wherein the second pressure chamber is connected with the load-sensing line.

14. A valve arrangement according to claim 10, wherein the lockable opening is formed on the circumference of the slide and covered over a certain movement path by the wall of a housing bore, in which the slide is arranged.

15. A valve arrangement according to claim 14, wherein the predetermined movement path is shorter than a path, after which the slide releases a connection between the pressure outlet and the high-pressure connection (P).

16. A valve arrangement according to claim 10, further comprising a non-return valve arranged in the longitudinal channel between the opening and the diagonal bore.

* * * * *